United States Patent [19]

McGee

[11] 4,089,065

[45] May 16, 1978

[54] CLOTHING FOR PROVIDING PROTECTION AGAINST FORCEFUL IMPACT

[76] Inventor: Michael Henry McGee, 412 E. Kingston Ave., Charlotte, N.C. 28203

[21] Appl. No.: 736,590

[22] Filed: Oct. 28, 1976

[51] Int. Cl.[2] ..... A41D 13/00

[52] U.S. Cl. ..... 2/2; 2/DIG. 3

[58] Field of Search ..... 2/2, DIG. 3, 413

[56] References Cited

U.S. PATENT DOCUMENTS

| | | | |
|---|---|---|---|
| 1,691,658 | 11/1928 | Kennedy | 2/2 X |
| 3,921,944 | 11/1975 | Morrison | 2/2 X |
| 3,930,667 | 1/1976 | Osuchowski et al. | 2/DIG. 3 |

FOREIGN PATENT DOCUMENTS

| | | | |
|---|---|---|---|
| 1,420,830 | 11/1965 | France | 2/413 |

*Primary Examiner*—Alfred R. Guest

*Attorney, Agent, or Firm*—James C. Kesterson

[57] ABSTRACT

A protective and attractive garment such as a jumpsuit is provided which has the appearance of a normal article of clothing. The garment is particularly suitable for hang-gliding or parachuting and is made from a fabric of two coextensive layers of close-weave material which offers substantial resistance to the flow of air or gas through the material. If an emergency arises which exposes the wearer to the danger of an injury due to forceful impact, the suit is inflated by providing a gas under pressure to the area between the two layers of material thereby surrounding the wearer with a protective air cushion.

17 Claims, 8 Drawing Figures

CLOTHING FOR PROVIDING PROTECTION AGAINST FORCEFUL IMPACT

BACKGROUND OF THE INVENTION

1. Field of the Invention

This invention relates to protective clothing for preventing injury to the wearer due to impact. More particularly, this invention relates to protective clothing for use in various adventurous sports or activities which require substantial freedom of motion, but at the same time pose significant danger due to falls from high altitudes or being propelled at high velocity into a solid object. Such high risk sports and activities include but are not limited to hang-gliding, mountain and rock climbing, parachuting, white water canoeing, race car driving and piloting of experimental aircraft. The protective clothing of this invention also, of course, has a great deal of potential for use in any other environment where a person might be injured by being forcibly thrown against another person or a solid object.

Protective clothing or garments manufactured in accordance with this invention could, of course, take various forms such as coveralls, jumpsuits, jackets, etc., depending on the type of activity and the parts of the body exposed to injury.

2. Prior Art

An investigation of the available references related to the field of protective clothing revealed no prior art that is significantly relevant to this invention. One reference, U.S. Pat. No. 1,105,569 issued to N. Lacrotte in 1914, is concerned with protective padding worn by aviators or motorists to avoid injury from blows from the steering wheel or other parts of the vehicle in case of an accident. The disclosed protective clothing is no more relevant (perhaps less) than modern day football padding or a crash helmet. The patent is entitled "Pneumatic Suit for Aviators" but there is certainly no teaching that the rubber core elements are "pneumatic" in the sense the term is used in the present invention. It would appear that each of the rubber core elements disclosed in the Lacrotte patent have been manufactured with permanently sealed air pockets, but nowhere is there any teaching of inflating the numerous air pockets at will. It will also be appreciated, of course, that this type of protective padding is cumbersome, heavy and bulky.

U.S. Pat. No. 3,550,159 issued to E. Alarco Dec. 29, 1970, does show an impact absorbing, lightly inflated padding or jacket for protecting persons in hazardous environments such as decks, cabins and cargo holds of ships and boats during rough weather. The structure of the padding disclosed in this patent includes a plurality of cell units which are connected by small passages such that air can flow slowly through the small passages from one cell to the next. This slow air flow results in the protective padding being somewhat flexible when subjected to relatively slow flexing movements. However, in the event of a sudden impact, the air cannot immediately move out of the affected cell units. Therefore, these affected cells remain initially in a resilient expanded state to absorb the impact but gradually collapse as the air continues to move from cell unit to cell unit. This type of protective clothing does not allow the unrestricted freedom of motion necessary for vigorous activity while it is providing protection.

There are, of course, on the market inflatable devices such as the well-known "Mae West" vest and other jackets similar to the type described in Bailhe U.S. Pat. No. 2,607,934 issued on Aug. 26, 1952 which provides safety in connection with water-related activities. However, the purpose of these devices is strictly for buoyancy in water and are not designed to provide protection from injury due to forcible impact. Two other patents dealing with pneumatic padding and garments include "Pneumatic Head Gear," U.S. Pat. No. 3,787,893 issued to A. C. Larcher June 29, 1974, which is somewhat similar to the teaching in the Alarco patent; and a "Pneumatic Coat" for providing warmth as described in the Kolb et al U.S. Pat. No. 2,608,690 which issued Sept. 2, 1952. Still other related technology is the concept of using air bags as packing between items of freight to avoid damage from impact during shipment. However, none of these references of devices in any way teach, much less incorporate the unique combination of elements taught by the present invention.

SUMMARY OF THE INVENTION

Therefore, it is an object of the present invention to provide an attractive lightweight piece of clothing which allows unrestricted movement and also offers effective protection against injury due to forcible impact.

It is another object of the present invention to provide protective clothing that is reusable.

It is still another object of the present invention to provide a piece of clothing that can serve as normal clothing under normal conditions, but can immediately become highly protective clothing when necessary.

Briefly, the protective clothing of this invention comprises a fabric made of two coextensive layers of abrasive resistant close-weave material which provides substantial resistance to the flow of gas therethrough. If an emergency arises while parachuting or hang-gliding which threatens the wearer with injury due to a forcible impact, a pressurized gas such as carbon dioxide is released from a cannister and conducted by means of connecting tubing to the space between the two layers of material. This pressurized gas then causes the garment to inflate or balloon and thereby enclose the wearer in a protective cocoon. The garment is sewed together with heavy duty seams and includes rugged heavy duty zippers or other closing means to secure the garment around the wearer and resist rupture due to a forceful impact.

In the preferred embodiment, the two coextensive layers of material are prevented from shifting and separating during normal wear by fastening means which release when the pressurized gas is introduced between the two layers. The preferred embodiment also includes openings through the garment so that a parachute or hang-gliding harness can be worn under the garment. The openings allow the harness to be connected to the attachment points or risers of the parachute or hang-glider. The two layers of material are, of course, sealed around the openings to prevent the escape of the inflating gas.

DETAILED DESCRIPTION OF THE INVENTION

Figure 1A:
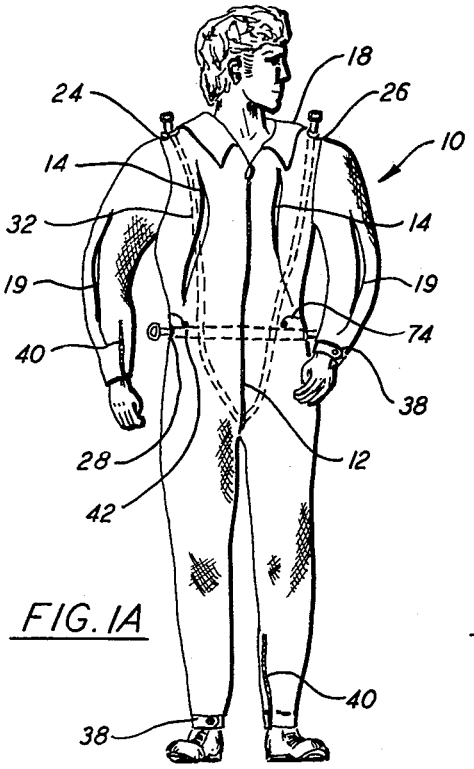
FIGS. 1A through 1C illustrate a jumpsuit or coveralll incorporating the features of this invention in the uninflated and normal wearing condition.
Figure 1B:
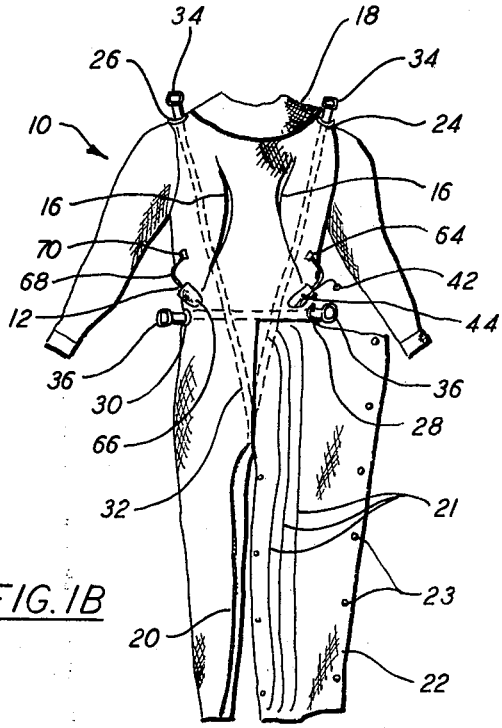

Referring now to FIG. 1, there is shown protective clothing which incorporates the concepts of the present invention in the normal uninflated state. The clothing illustrated is of the coverall or jumpsuit style; however, it will be appreciated that the clothing could also be in the style of a separate jacket or trousers. The style of garment will, of course, depend upon the individual wearer and the particular type of danger and impact which may be encountered. Garment 10 is fabricated from two coextensive layers of attractive, durable and abrasive resistant close-weave material such as nylon or the like, and is provided with suitable closing means 12, such as zippers, snaps, hooks, etc. Typically, these closing means 12 will be very rugged or heavy duty to avoid being inadvertently opened as a result of a forceful impact. The seams of this garment are extremely rugged to avoid rupturing under a heavy impact when inflated.

Shown at 14 and 16, running from the shoulder to the waist, are folds of extra material included in the outside layer of the two coextensive layers making up the garment. These folds allow expansion or ballooning of the garment when inflated. Collar 18 also includes extra folds of material so that when inflated the collar will balloon up around the neck and crash helmet thereby providing full protection of the very vulnerable neck and head area. Other folds of extra material may be included if desired at selected locations in the garment such as, for example, the sleeves shown at 19, and the trouser leg shown at 20. Alternatively, at all locations where extra material is required, several folds of cloth may be provided as shown at 21. These folds are concealed by flap 22 when the suit is not inflated. Flap 22 is held in place by releasable fastening means 23 including but not limited to adhesive, easily broken tacks of thread or Velcro TM fasteners such as discussed hereinafter.

Openings 24 and 26 illustrate two access points through both layers of material at the shoulder. Also shown are two similar openings 28 and 30 at the waist. These openings are provided to facilitate the use of a harness 32 which may be worn underneath the protective clothing. For example, for an activity such as parachuting, portions of harness 32 terminating in rings 34 are passed through the shoulder openings 24 and 26. These harness rings are then available for attaching to the risers of the parachute. Similarly, a harness for hang-gliding provides rings 36 at the waist as well as at the shoulders.

Tabs or straps 38 are shown for keeping the clothing snug around the ankles and wrists. Other fasterning means for keeping the clothing snug around the ankles and wrists may, of course, be used. For example, rugged zipper 40 is also suitable. Under some circumstances, it might not even be desirable to use anything to keep the clothing snug. However, such fastening means will prevent excess shifting of the clothing and will prevent the garment from climbing the arms or legs during use.

Figure 1C:
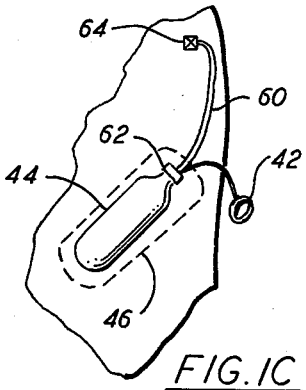

As is shown in detail in FIG. 1C, lanyard 42 is located at a convenient position such as shown on the front of the jacket. This lanyard releases the contents of a pressurized cannister 44 carried in pocket 46 into the space between the two layers of material from which the garment is made.

Figure 2:
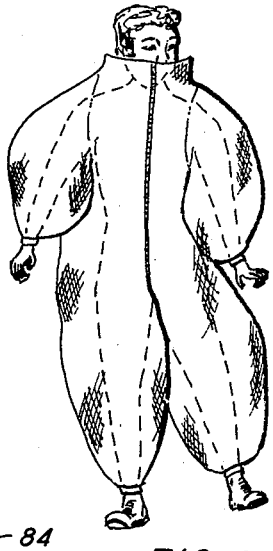
FIG. 2 illustrates the jumpsuit of FIG. 1 in the inflated emergency use condition.

Thus, it can be seen that in normal wear, the protective garment appears to be an attractive flight or jumpsuit as shown in FIG. 1. However, if danger threatens, the lanyard 42 is pulled which releases the pressurized gas between the two layers of material making up the garment and inflates or balloons the garment out around the body as is shown in FIG. 2. Thus, any forceful impact is absorbed by the inflated suit rather than the body and injury is prevented.

It should be noted at this point that whenever different Figures illustrate the same details, common reference numbers will be used if possible.

Figure 3A:
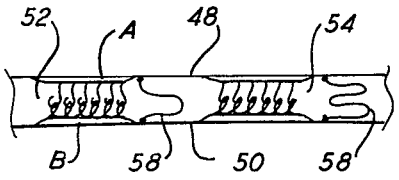
FIGS. 3A and 3B show a cross-section of a portion of the protective clothing in the uninflated and inflated conditions respectively.

Referring now to FIG. 3A, there is shown a cross-section of a portion of the protective clothing. Two coextensive layers 48 and 50 of a close-weave material make up the material from which the garment is made. In the preferred embodiment, the close-weave material is to resist the escape of a gas trapped between the layers of the material so that deflation will be at a very slow rate. As will be discussed hereinafter, it is only essential that the garment be in an inflated condition at the moment of the forceful impact. Therefore, it is not necessary that the garment be completely airtight if inflation takes place immediately before impact. Consequently, depending on the activity and the dangers involved, different fabrics having a wide range of porosities may be used. However, to provide adequate impact-absorbing qualities, the fabric should have a flow rate which will allow the garment to retain its impact-absorbing qualities for no less than thirty seconds.

Figure 3B:
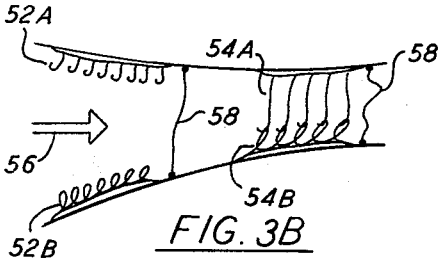
Figure 4:
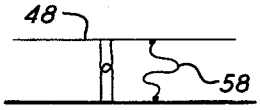
FIG. 4 shows an alternate embodiment for selectively joining the two layers of material together to avoid shifting and separating of the two layers.

It also may be important for certain styles of the clothing and the activity involved to prevent the layers of material from shifting and separating during normal wear when the garment is not inflated. The embodiment of FIG. 3A includes means for releasably joining the two coextensive layers of material at selected locations throughout the garment. As shown in the illustrated embodiment, VELCRO TM fasteners, manufactured by the Textron Company under U.S. Pat. Nos. 3,009,235; 3,154,837; and 2,083,737, are used to join the layers together. FIGS. 3A and 3B illustrate the operation of the VELCRO fastener. The two portions A and B of each fastener 52 and 54 are attached opposing each other on the two layers of the material. However, these fasteners 52 and 54 are such that they will release when pressurized gas is provided between the two layers of material. Therefore, as shown in FIG. 3B, as pressurized gas represented by arrows 56 is admitted between the two layers of material 48 and 50, portions A and B of fastening means 52 are forced apart by the increasing gas pressure. As the pressurized gas continues to be supplied between the layers of material 48 and 50, the remaining fastening means 54 will also be separated until the garment is fully inflated. Fasteners 52 and 54 are shown in the relaxed state in FIG. 3A. In the FIG. 3B, fastener 52 has been separated, and fastener 54 is in a state of tension and is about to separate. It will be appreciated that although VELCRO fasteners such as shown in FIGS. 3A and 3B, snap fasteners such as shown in FIG. 4, or any other such releasable fastening means will allow the protective garment to be deflated and reused as desired, other means of releasably joining the layers of material together such as a weak adhesive or easily broken tacks of thread are also suitable.

Optional straps 58, as shown in FIGS. 3A and 3B, are selectively located between the two layers of material 48 and 50 with the two ends attached to each of the two different layers. The straps 58 help to maintain the relative position of the two layers when the garment is in an inflated state, and may be used to restrict the bellowing or ballooning effect in desired portions of the garment by selecting different length straps. There is a strap 58 associated with each fastener 52 and 54 in the embodiment illustrated in FIGS. 3A and 3B. However, the location of such straps is optional and the use of such straps respresents a desired embodiment for certain styles of the protective garment or for certain types of activities.

Referring again to FIGS. 1A through 1C, cannister 46 contains a pressurized gas such as air, carbon dioxide ($CO_2$) or Helium (He) in pocket 44 of the garment. Tubing 60 connects cannister 46 to the garment by means of fittings 62 and 64, respectively. Fitting 62 includes a means for releasing the pressurized gas into the tubing. Such means may be a quick opening valve or a means for piercing the sealed opening of the pressurized cannister 46. Fitting 64 connects tubing 60 to the garment and provides a passage for the pressurized air or gas through one layer of the material to the space between the two layers of material. One end of lanyard 42 is connected to fitting 62 and provides a means for activated the release mechanism so that the pressurized gas can be delivered to the space between the two layers of material. The other end is conveniently located so that the person wearing the garment can quickly and easily reach the lanyard when threatened by a dangerous impact. It will be appreciated that for an activity such as hang-gliding, the end of the lanyard may be attached to the hang-glider so that if the rider was in some way separated from the hang-glider, the lanyard would be pulled automatically. An idenitcal cannister 66, tubing 68, fittings 70 and 72 and lanyard 74 arrangement is also provided as an emergency backup system. It will, of course, be appreciated that if a two-piece style of protective garment is used then connecting tubing between the two pieces or a separate and complete inflating system will be necessary for each piece.

Figure 5:
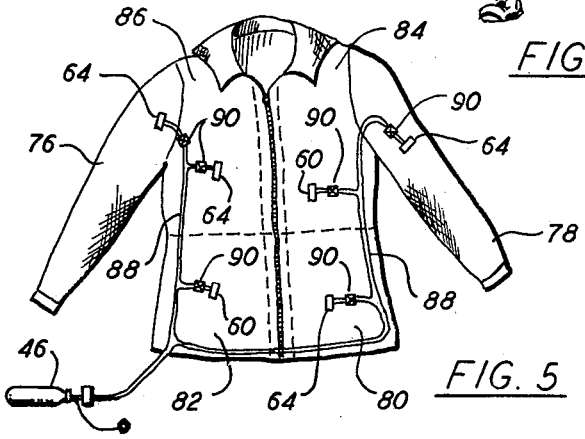
FIG. 5 shows an alternate embodiment of the present invention which incorporates several isolated yet inflatable sections of a protective jacket.

FIG. 5 illustrates a protective jacket which uses an alternate embodiment of the present invention wherein the space between the two layers of material is separated into isolated pockets by selectively sealing the two coextensive layers of material together. As shown in FIG. 5, the isolated pockets include sleeves 76 and 78 and pockets 80 through 86 which make up the front of the garment. Additional portions which are not shown would make up the back, collar, etc. In this embodiment, instead of a single tube connecting the pressurized cannister to one location on the garment, tubing network 88 connects the pressurized cannister 46 to each of the isolated portions 76 through 86 of the garment to permit the flow of pressurized gas from one isolated portion to another. Each branch of tubing network 88 includes a check valve 90 located between the cannister 46 and fittings 64. This embodiment provides additional protection in that if one portion of the garment was punctured or ripped, protection would still be provided by the undamaged portions of the garment. It should be understood, of course, that although only a protective jacket is shown in FIG. 5, any style of protective clothing, including jumpsuits and trousers, may use the concept of the alternate embodiment.

As was mentioned heretofore, close-weave nylon, rayon or the like are suitable materials. However, almost any other material may be used if they are provided with a rubberized backing or other means to restrict or prevent gas flow. In circumstances where air flow through the material is prevented rather than restricted, a manually activated relief valve may be incorporated. In other instances where it is desired to control the maximum inflation pressure applied between the layers of material, a flow valve may be included.

While there have been described what are at present considered to be preferred embodiments of this invention, it will be obvious to those skilled in the art that various changes and modifications may be made therein without departing from the invention, and it is, therefore, intended to cover all such changes and modifications as fall within the true spirit and scope of the invention.

I claim:

1. An inflatable garment for use in dangerous activities which when uninflated allows freedom of movement and has the appearance of an attractive article of clothing and when inflated provides protection from injury due to forceful impact comprising:

(a) a strong abrasive-resistant article of clothing comprising a fabric made of two coextensive layers of material which provide substantial resistance to the flow of a gas therethrough, such that said article of clothing is inflated when a gas under pressure is provided to the space between said layers, heavy-duty seams for resisting rupture due to impact when said article of clothing is inflated, and heavy-duty closing means for securing the article of clothing around the wearer to provide protection against said clothing opening as a result of a forceful impact;

(b) means for containing a gas under pressure;

(c) means for connecting said space between said two coextensive layers of material to said means for containing a gas under pressure, said connecting means suitable for transferring a gas under pressure;

(d) means for releasing pressurized gas from said container means, through said connecting means and into said space between said two coextensive layers of material to inflate said article of clothing, thereby protecting the wearer from injury due to forceful impact; and (e) a multiplicity of means for releasably fastening said two coextensive layers of material so that said layers will not shift and separate during normal wear, but will release when said pressurized gas is provided between said layers to allow said garment to inflate.

2. The garment of claim 1 and further comprising extra folds of material in the outermost one of said two coextensive layers for allowing the garment to expand to a greater volume when inflated to provide increased protection.

3. The garment of claim 2 and further comprising a flap of material for covering said extra folds of material when said garment is not inflated, and releasable fasteners to hold said flap of material in place to cover said uninflated extra folds of material.

4. The garment of claim 1 wherein said means for fastening are at least a fastener selected from the group consisting of Velcro fasteners, snaps, tacks of thread and adhesive.

5. The garment of claim 1 and further comprising a multiplicity of straps selectively located between and connecting said two coextensive layers of material for controlling the distance between said layers when inflated.

6. The garment of claim 1 wherein said garment includes openings through said fabric at selected locations for providing external connection to a harness worn under said garment, said two layers of material being sealed together around said opening to prevent the escape of said pressurized gas.

7. The garment of claim 1 wherein said two coextensive layers of material are sealed together at selected locations to provide isolated pockets to contain said pressurized gas, and wherein said means for connecting is a multiplicity of passages connecting said means for containing with each of said isolated pockets, and further comprising check-valves located in selected ones of said multiplicity of passages to allow gas flow from said containing means to said isolated pockets and to prevent gas flow between said isolated pockets.

8. The garment of claim 1 wherein said gas contained under pressure is at least a gas selected from the group consisting of air, helium and carbon dioxide.

9. The garment of claim 1 wherein each of said coextensive layers of material is at least a material selected from the group consisting of nylon, rayon, and rubber-backed cotton which has a flow rate therethrough which will allow the garment to retain its impact-absorbing qualities for no less than thirty seconds.

10. An inflatable garment for use in dangerous activities which when uninflated allows freedom of movement and has the appearance of an attractive article of clothing and when inflated provides protection from injury due to forceful impact comprising:

(a) a strong abrasive-resistant article of clothing comprising a fabric made of two coextensive layers of material which provide substantial resistance to the flow of a gas therethrough, such that said article of clothing is inflated when a gas under pressure is provided to the space between said layers, heavy-duty seams for resisting rupture due to impact when said article of clothing is inflated, and heavy-duty closing means for securing the article of clothing around the wearer to provide protection against said clothing opening as a result of a forceful impact;

(b) means for containing a gas under pressure;

(c) means for connecting said space between said two coextensive laters of material to said means for containing a gas under pressure, said connecting means suitable for transferring a gas under pressure;

(d) means for releasing pressurized gas from said container means, through said connecting means and into said space between said two coextensive layers of material to inflate said article of clothing, thereby protecting the wearer from injury due to forceful impact; and (e) a multiplicity of openings through said fabric at selected locations for providing external connection to a harness worn under said garment, said two layers of material being sealed together around said opening to prevent the escape of said pressurized gas.

11. The garment of claim 10 and further comprising extra folds of material in the outermost one of said two coextensive layers for allowing the garment to expand to a greater volume when inflated to provide increased protection.

12. The garment of claim 11 and further comprising a flap of material for covering said extra folds of material when said garment is not inflated, and releasable fasteners to hold said flap of material in place to cover said uninflated extra folds of material.

13. The garment of claim 10 and further comprising a multiplicity of means for releasably fastening said two coextensive layers of material so that said layers will not shift and separate during normal wear, but will release when said pressurized gas is provided between said layers to allow said garment to inflate, said means for fastening are at least a fastener selected from the group consisting of Velcro fasteners, snaps tacks of thread and adhesive.

14. The garment of claim 10 and further comprising a multiplicity of straps selectively located between and connecting said two coextensive layers of material for controlling the distance between said layers when inflated.

15. The garment of claim 10 wherein said two coextensive layers of material are sealed together at selected locations to provide isolated pockets to contain said pressurized gas, and wherein said means for connecting is a multiplicity of passages connecting said means for containing with each of said isolated pockets, and further comprising check-valves located in selected ones of said multiplicity of passages to allow gas flow from said containing means to said isolated pockets and to prevent gas flow between said isolated pockets.

16. The garmet of claim 10 wherein said gas contained under pressure is at least a gas selected from the group consisting of air, helium and carbon dioxide.

17. The garment of claim 10 wherein each of said coextensive layers of material is at least a material selected from the group consisting of nylon, rayon, and rubber-backed cotton which has a flow rate therethrough which will allow the garment to retain its impact-absorbing qualities for no less than 30 seconds.

* * * * *